United States Patent [19]

Gehring

[11] 4,420,912

[45] Dec. 20, 1983

[54] APPARATUS FOR HOLDING WORKPIECES DURING HONING WORK

[75] Inventor: Heinz Gehring, Ostfildern, Fed. Rep. of Germany

[73] Assignee: Maschinenfabrik Gehring Gesellschaft mit beschränkter Haftung & Co. Kommanditgesellschaft, Ostfildern, Fed. Rep. of Germany

[21] Appl. No.: 239,119

[22] Filed: Feb. 27, 1981

[30] Foreign Application Priority Data

Feb. 27, 1980 [DE] Fed. Rep. of Germany ..... 3007261

[51] Int. Cl.[3] ..... B24B 19/00

[52] U.S. Cl. ..... 51/227 R; 51/217 R; 269/234; 269/238

[58] Field of Search ..... 51/227 R, 217 R, 59 R; 269/234, 238, 237, 91, 93, 315, 152, 153, 287, 288, 282, 283, 285, 254 CS

[56] References Cited

U.S. PATENT DOCUMENTS

| | | | |
|---|---|---|---|
| 1,939,205 | 12/1933 | Connor | 51/217 R |
| 2,342,146 | 2/1944 | Joyce | 269/238 X |
| 2,596,321 | 5/1952 | Zimmerman | 51/227 R |
| 2,908,205 | 10/1959 | Furman et al. | 269/238 X |
| 3,087,281 | 4/1963 | Greening et al. | 51/217 R X |
| 3,114,990 | 12/1963 | Ferkins et al. | 269/254 CS X |
| 3,122,867 | 3/1964 | Gross | 51/227 R |
| 3,289,356 | 12/1966 | Hunt et al. | 51/227 R |
| 3,552,069 | 1/1971 | Butler | 51/227 R |
| 3,758,099 | 9/1973 | Scott | 269/234 X |
| 3,891,201 | 6/1975 | Clugage | 269/285 X |
| 4,171,800 | 10/1979 | Weaver | 269/234 X |

*Primary Examiner*—Frederick R. Schmidt
*Assistant Examiner*—Steven P. Schad
*Attorney, Agent, or Firm*—Becker & Becker, Inc.

[57] ABSTRACT

An apparatus for holding of workpieces with at least one vertical bore, particularly for holding a connecting rod, for a honing operation. The apparatus includes two workpiece receiving plates between which the workpiece is insertable with horizontal and vertical play. The workpiece receiving plates have an opening for receiving the honing tool. A holding device is provided and is fixable relative to a workpiece receiving plate; vertically the holding device engages the workpiece free of play at a slight engagement pressure. The holding device is freely movable toward the workpiece in a first direction, and is immovable in the opposite direction. The honing device comprises at least one angle lever, which is tiltable or pivotally journalled relative to a workpiece receiving plate, has one arm engaging against the workpiece, and has the other arm connected with a device which restrains the angle lever in the release or loosening direction.

7 Claims, 5 Drawing Figures

APPARATUS FOR HOLDING WORKPIECES DURING HONING WORK

The present invention relates to an apparatus for holding workpieces with at least one vertical bore, especially for holding a piston rod or connecting rod, for honing work. The apparatus comprises two workpiece receiving plates between which the workpiece is insertable with horizontal and vertical play. The workpiece receiving plates have an opening for receiving the honing tool.

With known apparatus of this type, for instance during honing of the bores, the workpieces, such as connecting rods for which the bores must extend exactly at right angles to the planar surfaces, are inserted from the side into an apparatus having several parallel plates arranged one above the other, with the spacing of these plates corresponding to the workpiece thickness. The positioning of the workpieces is determined by abutments, whereby play results on all sides.

To permit passage of the honing tool therethrough, the plates are provided with bores which are slightly larger than the workpiece bores which are to be machined. The workpieces can float toward the honing tool as a consequence of the play. The torque exerted by the tool upon the workpieces during machining thereof is absorbed by an abutment at the other end of the workpieces, which under these circumstances serve as a lever.

With these devices, the play which the workpieces have in axial direction of the honing tool, i.e. vertically between the tool receiving plates, has a disadvantageous effect in relation to the attainable accuracy of the workpieces. This play namely must necessarily be so great that also those workpieces lying in the upper tolerance limits for the workpiece thickness still fit into the receiving location. The workpieces tilt toward the axial direction of the honing tool during machining of the bores, so that considerable perpendicularity errors arise with respect to the planar surfaces.

For this reason, with another known apparatus, the workpieces, after being inserted between the workpiece receiving plates, are clamped axially and are held immovable. Here, however, the floating-in of the workpieces toward the honing tool, which is necessary for attaining a high accuracy, is no longer provided, and an accurate alignment of the workpieces toward the center of the tool is first necessary.

It is an object of the present invention to provide a workpiece holding apparatus which holds the workpieces in such a way that vertically, i.e. in the axial direction of the honing tool, they are held in a play-free manner, yet horizontally they are movable, so that the workpiece cannot tilt relative to the honing tool. The holding device is to be built in a simple, straightforward manner, and should be easy to operate.

These and other objects and advantages of the present invention will appear more clearly from the following specification in connection with the accompanying drawings, in which.

Figure 1:
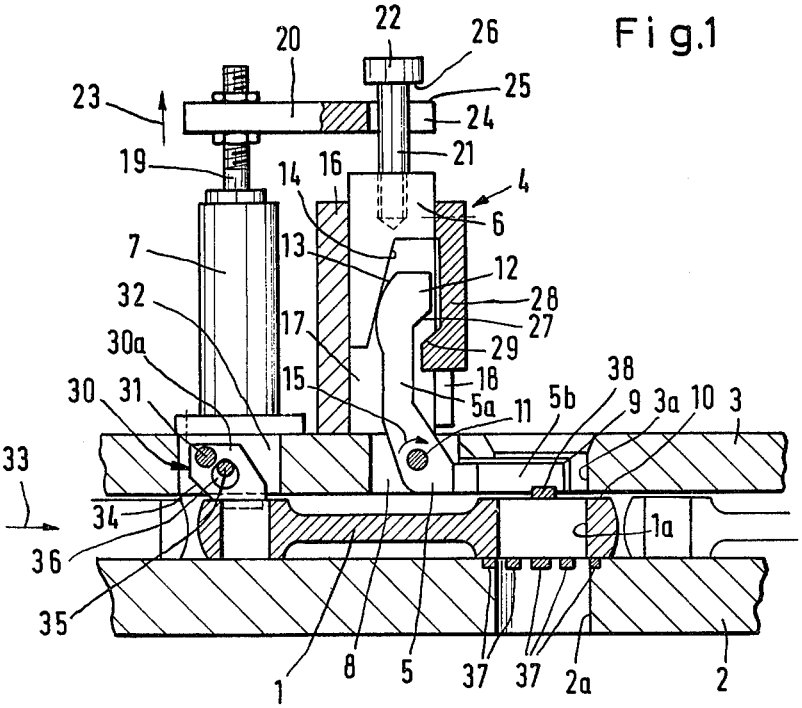
FIG. 1 is an axial section through an inventive embodiment of the holding device.

The holding apparatus of the present invention is characterized primarily by a holding device which is capable of being secured in position relative to a workpiece receiving plate; vertically the holding device engages the workpiece free of play under slight engagement pressure; the holding device is freely movable toward the workpiece in a first direction, and is immovable in the opposite direction.

Since the holding device is freely movable in the direction toward the workpiece, after introduction of the workpiece it engages the latter free of play. The workpiece is now held vertically immovable since the holding device is blocked in the loosening or release direction and has secured itself in an immovable manner. Consequently there is attained that the holding device automatically adapts to the differing workpiece thicknesses and vertically secures the workpiece without clamping it horizontally.

An advantageous embodiment is provided by an angle lever which is journalled so as to be fixed against rotation relative to the workpiece receiving plates. One arm of the angle lever is fixed in a housing by means of a drop wedge, so that the angle lever is held immovable in the loosening or release direction of the arm which presses against the workpiece. The drop wedge is embodied in such a way that as a result of its weight, no engagement force of the arm of the angle lever engaging against the workpiece that is too large can occur, so that the workpiece is horizontally extensively freely movable. Similar engagement forces are attainable by preloaded springs which are effective upon the wedge. In such an embodiment, the holding device is relatively independent of the position of the workpiece receiving plates. According to a further inventive embodiment of the holding device, the honing tool is journalled in a dual rigid manner on the workpiece receiving plates, whereby the supports or bearings are preferably arranged on opposite sides of the workpieces. The thus obtained exact guidance of the honing tool, in connection with the horizontally movable yet vertically play-free insertion of the workpieces, assures a previously unattained accuracy, especially with regard to the trueness of fhe planar surfaces relative to the bore, and to the interconnecting of the two bores relative to each other.

Further features and advantageous expedient further embodiments of the present invention are apparent from the following disclosure. For instance, the holding device may be formed by at least one angle lever, which is tiltable or pivotably journalled relative to a workpiece receiving plate, engages with an arm against the workpiece, and with the other arm is connected with a device which restrains the angle lever in the release or loosening direction.

One arm of the angle lever may surround the bore to be machined in a fork-like manner, and, preferably under spring force, may engage the workpiece diametrically to the bore at two locations. That arm of the angle lever which engages the workpiece may have elevated, preferably spherical, engagement surfaces. The engagement surface of that arm of the angle lever engaging the workpiece may be formed by a small hard metal plate. That plane parallel engagement surface of the workpiece facing away from the arm of the angle lever may be supported on small hard metal plates inserted in the workpiece receiving plate. The angle lever may be immovably secured in its release direction by a wedge which is supported on a workpiece receiving plate. The wedge may be self restraining, and may be liftable by means of a lifting device in the loosening or release direction. An abutment device, externally of the middle axis, may secure the workpiece only in the rotational direction of the tool. The abutment device may be formed by a drop lever which is tiltably arranged in a recess of one of the workpiece receiving plates by means of a pin, permitting tilting movement in the workpiece transporting direction.

Two hold-down devices may be provided for securing the workpiece. The engagement surfaces of the hold-down devices may form an equilateral triangle, the apex of which lies on the middle or central axis of the workpiece. The angle lever may be forcibly engaged in the release direction by the force of a preloaded spring which is arranged in a bore in the workpiece receiving plate. The angle lever may have two essentially horizontal arms which extend displaced relative to one another, and the wedge which secures the angle lever may be horizontally shiftable and is preferably forcibly engaged by a preloaded spring in the direction toward the axis of rotation of the angle lever.

The wedge, which may be arranged on a shaft, may be pivotable in its release direction by a follower rod which is held in brackets which are rotatably journalled on the ends of the rotary shaft. Several workpiece receiving plates may be placed one above the other with the intervention of spacers, and may be connected into a block by means of bolts. The honing tool may be guided, with cylindrical extensions, in the axial direction and to both sides of the workpiece receiving plate in a guide bearing which is rigidly connected with the workpiece receiving plate. With two-part connecting rods, engagement surfaces may be provided on the rod part.

Figure 2:
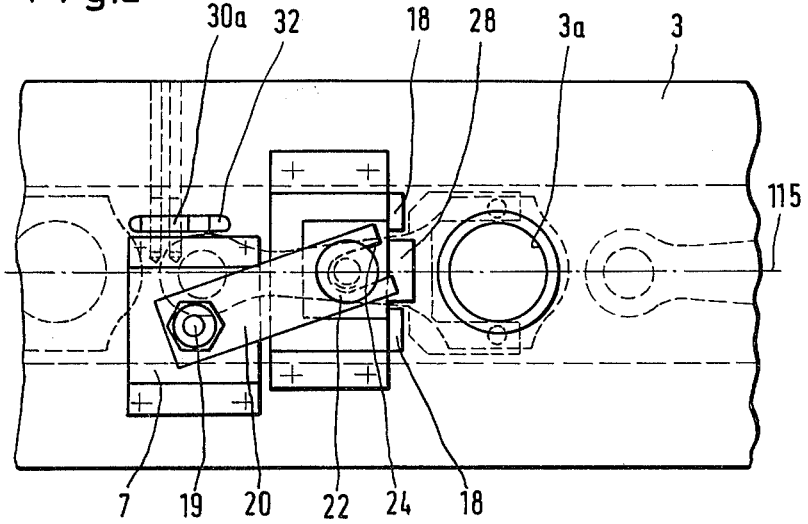
FIG. 2 is a plan view of the holding device of FIG. 1.

Referring now to the drawings in detail, the workpiece holding device illustrated in FIGS. 1 and 2 displays a workpiece, for instance a connecting rod 1, which is placed or inserted for machining or working of the bore 1*a*, for instance by honing, between first and second workpiece receiving plates 3 and 2; during the machining, the workpiece is held vertically immovable by an inventive holding device 4. The plates 2, 3 are provided with through passages or bores 2*a*, 3*a* for permitting a non-illustrated honing tool to pass therethrough. These bores 2*a*, 3*a* are slightly larger than the workpiece bore 1*a* which is to be machined. The connecting rod has a first surface extending perpendicular to the axis of the bore and a second surface extending generally perpendicular to the first surface.

The holding device 4 essentially comprises an angle lever 5 which is rigid and which at its vertically upwardly directed arm 5*a* is actuated by a drop key or wedge 6 in such a way that the two preferably point-type elevated, first engagement surfaces 9 of the fork-shaped arm 5*b* of the lever 5, which arm extends transverse to the axial direction, engages the planar or first surface 10 of the workpiece 1. A clean or neat holding is assured by the selection of the planar surface 10, though it is also possible to permit the hold-down device to engage at other engagement points on the workpiece 1.

The angle lever 5 is tiltably journalled in a recess 8 in the upper workpiece receiving plate 3 by means of a pin 11. The widened or enlarged end 12 of the axially upwardly directed leg 5*a* is provided with a spherical surface 13 which forms a second surface that cooperates with an opposed surface in housing 16 on first plate 3 and the wedge surface 14 of the axially downwardly tapering drop wedge 6, which is effective by its own weight. As a result, the angle lever 5 is tilted in the drop direction 15 until the first or engagement surfaces 9 engage against the planar surface 10 of the workpiece 1. In accordance with the present invention, the weight of the drop wedge 6 is relatively small, so that the engagement pressure against the workpiece 1 is very small and the horizontal capability of movement thereof is not significantly affected.

However, large forces can be taken up in vertical direction by the inventive holding device, since a return movement of the angle lever 5 in the release or loosening direction, i.e. counter to the direction of the arrow 15, is precluded by the self-restraining arrangement of the wedge connection 13, 14.

The drop wedge 6 is slidably displaceably supported in a housing 16 mounted on the upper workpiece receiving plate 3. The housing 16 is preferably embodied having a U-shaped cross section for this purpose, and forms, together with two guide strips 18 screwed onto the legs of the "U", an essentially quadratic hollow chamber 17 for receiving the drop wedge 6 (FIGS. 1 and 2). To discontinue the play-free holding-down, for instance after termination of the honing work, and to replace the workpiece 1, the drop wedge 6 is preferably lifted positively by the force effect of the lifting cylinder 7 counter to the dropping direction until, by subsequently described means, the angle lever 5 is moved counter to the arrow direction 15, whereby the engagement surfaces 9 of the planar surface 10 of the workpiece 1 lift a certain amount.

The transfer of the movement of the piston rod 19 of the lifting cylinder 7 arranged adjacent to the housing 16 on the upper workpiece receiving plate 3 onto the drop wedge 6 is effected by a transverse bracket 20 which is connected rigidly with the piston rod and engages against the collar or flange 22 of the bolt 21, which is rigidly screwed to the drop wedge 6. If pressure medium is supplied to the lifting cylinder, its piston, along with the piston rod 19 thereof, moves in the direction of the arrow 23. A groove-like recess 24 of the transverse bracket 20 has the shaft of the collar bolt 21 passing therethrough with play. The upper planar surface 25 of the transverse bracket 20 engages against the inner planer surface 26 of the collar 22, hence lifting the collar bolt 21 together with the drop wedge 6. Consequently first the wedge surface 14 of the drop wedge 6 comes free from the spherical surface 13 of the angle lever 5, and in the course of further movement, the nose 29 of the leg 28, which is rigidly connected with the drop wedge 6 and advantageously extends downwardly between the guide strips 18, strikes or engages that inclined surface 27 of the angle lever 5 arranged across from the spherical surface 13, whereby the angle lever 5 is tilted counter to the arrow direction 15 and releases the workpiece 1.

The drop wedge 6 moves downwardly again by its own weight during a movement of the piston rod 19 in the opposite direction (counter to the arrow 23), for instance upon termination of changing of the workpiece; at the same time, the nose 29 of the leg 28 again frees the inclined surface 27 of the angle lever 5, and subsequently there is effected the holding down of the inserted workpiece by way of the wedge surface 14 of the drop wedge 6, as previously described. The stroke or lift path of the cylinder 7 is advantageously so arranged that the upper planar surface 25 of the transverse bracket 20 is freed of the collar surface 26 of the bolt 21 by a certain amount. This assures that the device can automatically adapt to the different workpiece heights by the effect of gravity without having the drop wedge 6 strike or engage against a disturbing abutment.

The torque exerted upon the workiece during the machining by the tool is advantageously absorbed by an abutment device 30. With the present embodiment of FIGS. 1 and 2, this abutment device 30 comprises a drop lever 30*a*, which is journalled by means of a pin 31 in a slot-like recess 32 in the upper workpiece receiving plate 3 in such a way that it projects partially into the space between the workiece receiving plates and forms an abutment for the workpiece. The drop lever 30*a* has an inclined surface 34 which faces the workpiece transporting direction (arrow 33), and which the workpiece 1 engages during transport, pivoting the abutment out of the transporting region, i.e., the drop lever 30*a* dips completely into the slot-like recess 32 in the upper workpiece receiving plate 3 in order to permit the wide part of the workpiece 1 to pass through. The drop lever thereupon drops back into its abutment position by its own weight. As is apparent from FIG. 2, the drop lever 30*a* is arranged off center relative to the middle axis 115, and engages one side or second surface surface of the workpiece 1.

The abutment position is limited by a pin 35 which passes through a bore 36 in the drop lever 30*a*. The bore 36, in conformity with the pivot path of the drop lever 30*a*, has a larger diameter than does the pin 35, which is rigidly seated in the workpiece receiving plate 3 on both sides of the slot-like recess 32.

As further shown by FIG. 1, the lower workpiece receiving plate 2 can be highly wear resistant along the periphery of the bore 2*a* in the region of the workpiece engagement; advantageously, inserted small hard metal or carbide tipped plates 37 form the workpiece engagement. Similarly, the elevated engagement surfaces 9 of the angle lever 5 can advantageously be formed by small hard metal plates 38 soldered thereon or applied in another suitable manner which form first surfaces engaging only the first or top surface of the connecting rod. With these measures, the frictional wear of the engagement surfaces on the workpiece receiving plate, which wear arises during the honing work as a result of the floating movement of the workpieces, is kept very small.

Figure 3:
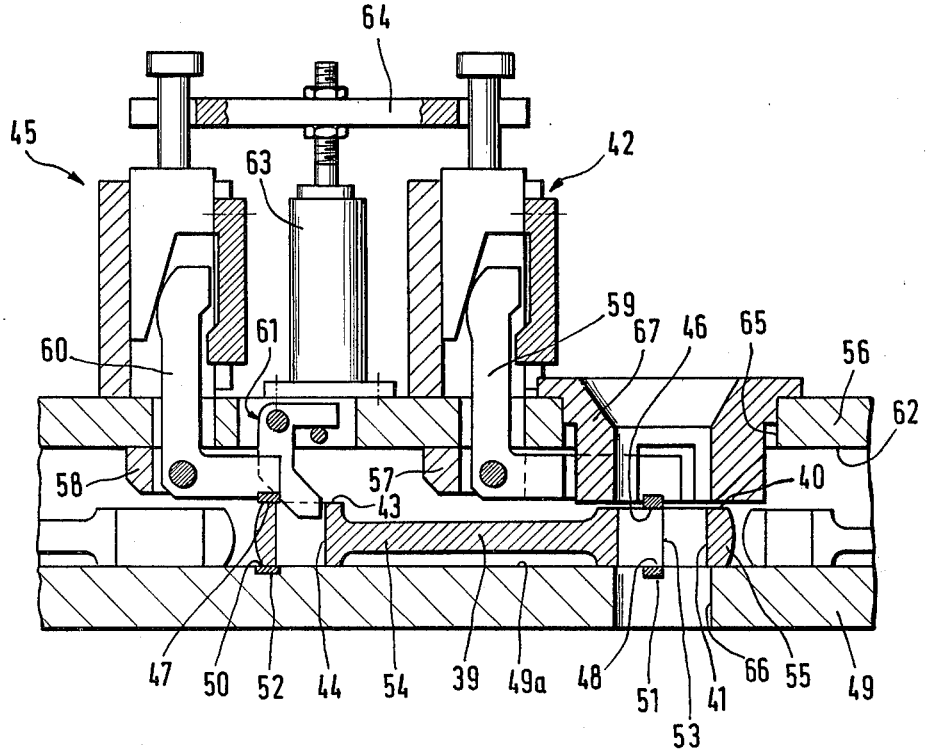
FIG. 3 is an axial section through a further inventive embodiment with a dual or double arrangement of the holding device.

FIG. 3 shows a further embodiment in accordance with the present invention with dual-arranged holding-down of the workpiece. This is advantageous, for instance, when a three-point engagement is required for reasons of pre-working, and a tilting of the workpieces could occur by the machining forces that arise.

In the illustrated embodiment, the workpiece, for instance a connecting rod 39, is held down by a first holding device 42, the angle lever 59 of which surrounds the bore 41 in a fork-like manner, on the planar surface 40 around the bore 41 to be worked or machined. A second holding device 45 engages at the oppositely located end of the workpiece, for instance on the planar surface 43 around the smaller diameter bore 44. This second holding device 45 holds the workpiece 39 down free of play. In this connection, the engagement surface 47 of the angle lever 60 is centered with respect to the middle axis 115. The overall arrangement is advantageously such that the respective point-type elevated engagement surfaces 46, 47 of the hold-down devices 42, 45 provide an approximately equilateral triangle, the apex of which is located on the middle axis 115. In order to preclude every tipping or tilting movement of the workpiece 39, the three-point engagement of the workiece 39 on the workpiece receiving plate 49 is such that the engagement surfaces 48, 50 are located approximately opposite the engagement surfaces 46, 47.

The three-point engagement 48, 50 of the workpiece 39 is preferably formed by three small hard metal or carbide tipped plates 51, 52 which are introduced into the lower workpiece receiving plate 49. The small hard metal plates 51, 52 project slightly, preferably 0.1 mm, relative to the upper planar surfaces 49*a* of the workpiece receiving plate 49, said planar surfaces 49*a* representing the transporting plane or level. In this connection, the plates 51 arranged on both sides of the bore 41 form an equilateral triangle with the plate 52 arranged in the vicinity of the bore 44. The edges of the projecting small hard metal plates 51, 52 are advantageously chamfered to assure a smooth gliding of the workpieces thereon during feeding or supplying of the device. Advantageously, the three-point engagement with two-part connecting rods is preferably provided on the so-called rod part 54 of the connecting rod 39. As shown in FIG. 3, the engagement surfaces 46, 47, 48 of a three-point engagement are preferably arranged in such a manner that the engagement surfaces 46 reach to the separating plane 53 located in the axis of the bore, and are limited thereby. The separating plane 53, which separates the rod part 54 from the top 55, is located at right angles to the middle axis 115 of the connecting rod.

Consequently, there are avoided the effects influencing the accuracy by possible errors in the planar surfaces of the top in relation to the planar surfaces of the rod and the bores 41, 44.

The holding devices 42, 45, and the abutment device 61 provided for absorbing the torque, essentially correspond in construction and manner of operation to the previously described holding device 4 or abutment device 30 in FIG. 1, so that reference can be made to the foregoing description for this purpose. In contrast to the embodiment illustrated in FIG. 1, the spacing between the workpiece receiving plates 49, 56 is larger, and the angle levers 59, 60 are journalled in separate support blocks 57, 58 which are fastened to the underside 62 of the upper workpiece receiving plate 56. Advantageous with this arrangement is the fact that a weakening of the upper workpiece receiving plate 56 by way of the otherwise necessary milling-out for the journalling and receiving of the angle levers is avoided, and simultaneously the production of the workpiece receiving plate is made considerably less expensive. In addition, a better accessibility is provided by way of the greater spacing between the workpiece receiving plates 49, 56. The supplying or feeding of workpieces between the workpiece receiving plates 49, 56 is also simplified.

The discontinuance of play-free holding down after machining has terminated is effected by a lifting cylinder 63 which simultaneously actuates both holding devices 42, 45 by means of a transverse bracket 64 in the described manner. In this connection, the lifting cylinder 63 is advantageously arranged between the housings for the wedges of the holding devices 42, 45, so that the transverse bracket 64 can be fastened approximately centrally on the stroke or lift rod of the lifting cylinder.

The workpiece receiving plates 49, 56 are provided with through passages or bores 65, 66 for permitting the non-illustrated honing tool to pass through. The through passage or bore 65 of the upper workpiece receiving plate 56 is greater in diameter and receives a funnel-shaped guide 67 which facilitates the automatic introduction of the honing tool at the beginning of the machining process.

Figure 4:
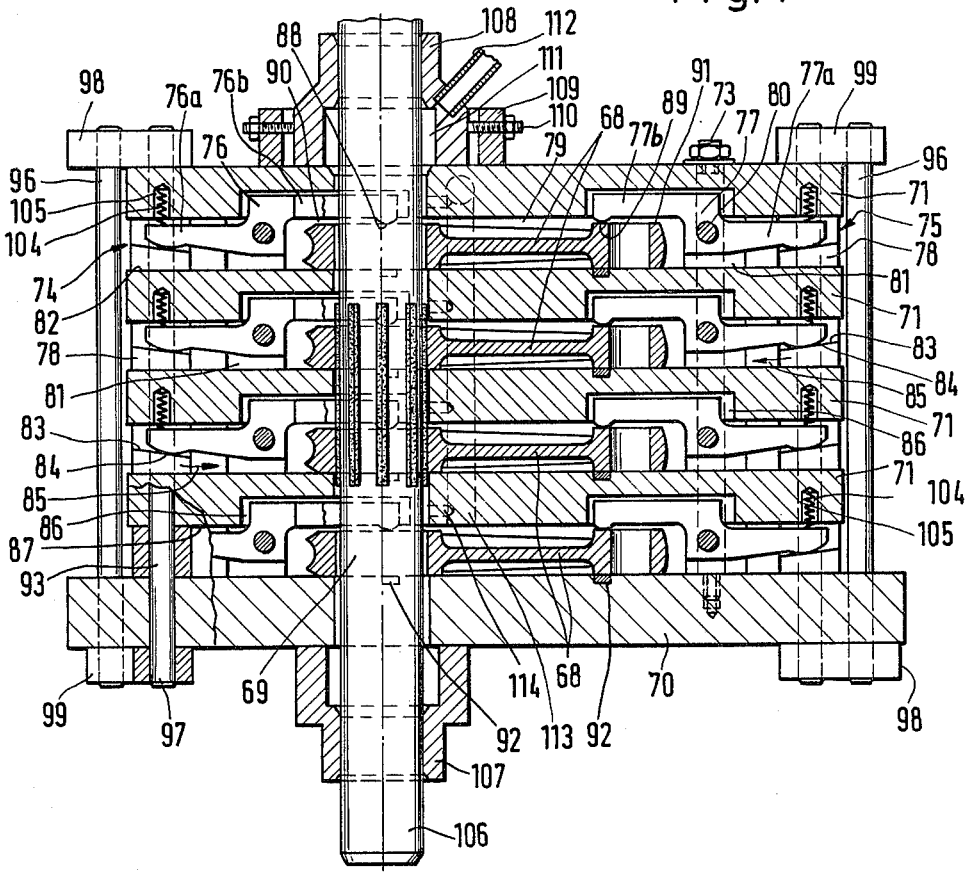
FIG. 4 is an axial section through a further embodiment of the inventive holding device with multiple workpiece receiving means and counter-journalled honing tool.
Figure 5:
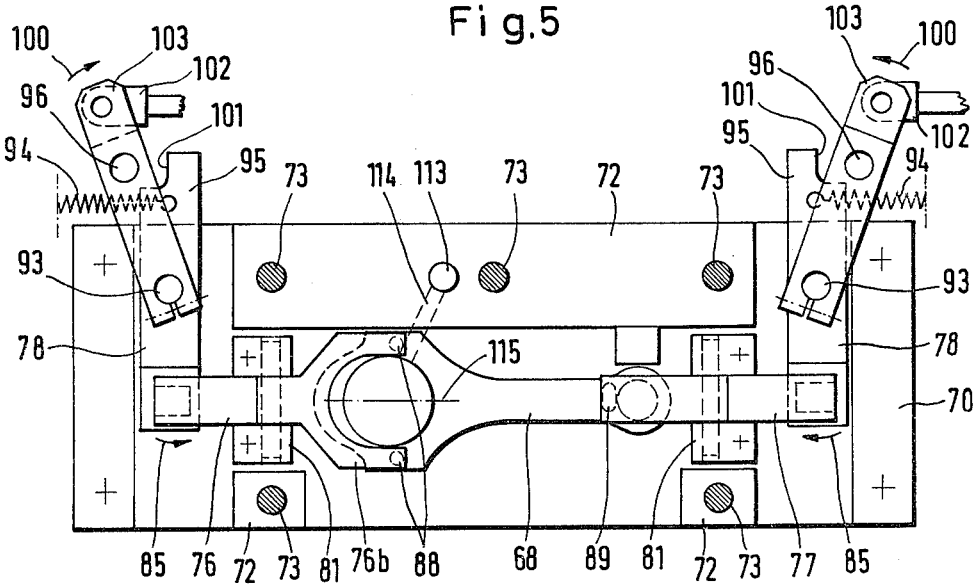
FIG. 5 is a plan view of the holding device of FIG. 4.

FIGS. 4 and 5 show a further especially advantageous embodiment of the invention with multiple workpiece receiving means, dual workpiece holding-down, and counter journalled honing tool.

Several, for instance four, workpieces 68 are arranged axially above each other with this embodiment. These workpieces 68 are simultaneously machined by a schematically indicated honing tool 69, whereby each workpiece itself is held down in a dual play-free manner.

For this purpose, workpiece receiving plates 71 are alternately stacked with spacers 72 above one another on a base plate 70 in such a way, and these plates and spacers are connected by bolts 73 with the base plate 70 into a block, that gaps or spaces 79 result one above the other for receiving the workpieces 68.

Holding devices 74, 75 are arranged on both sides of the workpieces; these holding devices correspond in manner of operation to those already described for the foregoing embodiments. Differences in structural embodiment are based upon the changed space conditions. These differences essentially comprise that the tiltably journalled lever 76, 77 of each holding device 74, 75 has two horizontally extending arms 76*a*, 76*b* or 77*a*, 77*b*. The wedges 78 for the actuation of the levers 76, 77 are now horizontally shiftable. These wedges 78 are forcibly engaged by preloaded springs 94 which engage at the end of a wedge 95 in the direction toward the axes of rotation 80 of the lever means 76, 77. The manner of operation corresponds to the wedge effect in the already previously described embodiments of FIGS. 1–3. An especially flat manner of construction of the holding device is provided by this embodiment; this flat construction can be accommodated within the spaces 79 between the workpiece receiving plates 71. The levers 76, 77 are pivotally or tiltably journalled by means of pins 80 in separate support blocks 81 which are fastened, for example by screws, on the upper sides 82 of the workpiece receiving plates 71 on both sides of the workpieces.

That lever arm 76*a* or 77*a* of each lever 76 or 77 directed away from the workpiece has at its end a spherical surface 84 which cooperates with a wedge surface 83 of the respectively associated wedge 78, the wedge surface 83 tapering in the direction toward the workpiece 68. A tilt or pivot movement of the levers 76, 77 is produced by a movement of the wedges 78 in the direction of the arrows 85. Consequently, the second lever arm 76*b* or 77*b*, which extends over the workpiece 68, engages against the planar surfaces 90, 91 of the workpieces 68 with its point-type elevated engagement surfaces 88, 89. In this connection, the second lever arm 76*b*, 77*b* is located in a recess 86 on the underside 87 of the workpiece receiving plate 71.

As particularly shown in FIG. 5, the lever arms 76*b* are fork-shaped to allow the honing tool 69 to pass through, and the engagement surfaces 88 or 89 are selected in such a way that they are located approximately opposite to the three-point engagement 92 for the workpiece as provided in the upper side 82 of the workpiece receiving plates, as described in detail in connection with FIG. 3.

The wedges 78 are pivotably journalled between the workpiece receiving plates 71 by means of bearing bolts 93. The bearing bolts 93 extend from the base plate 70 axially through all of the workpiece receiving plates 71. The wedges 78 are forcibly engaged by way of the force of the tension springs 94 in the direction of the arrow 85. These springs 94 respectively engage those ends 95 of the wedges opposite from the wedge surfaces 83. The force of the springs 94 is inventively so determined or adjusted that the engagement pressure of the engagement surfaces 88 or 89 against the workpieces 68 is very small, and the horizontal capability of movement of the workpieces is not notably impaired. Nonetheless, as described with reference to the embodiments of FIGS. 1–3, large forces can be taken up in the axial direction since the wedge connections 83 and 84 inventively are arranged in a self-restraining manner and preclude any oppositely directed movement.

An axially extending follower rod 96 is respectively provided for discontinuing the play-free holding-down 74, 75 on both sides of the workpieces 68. This follower rod 96 is pivotably arranged on the respective bearing bolt 93 for the wedges 78 by means of two brackets 98, 99 which are rigidly connected with the follower rods 96 and are fastened to the projecting ends 97 of the bearing bolts 93.

During a pivot movement in the direction of arrow 100, the follower rods 96 press against the end 95 of the wedge 78, which end has an offset abutment surface 101, whereby these wedges 78 are moved in the release or loosening direction counter to the direction of arrow 85.

The pivot movement of the follower rod 96 can be effected, for example, by the force effect of a non-illustrated hydraulic cylinder, the piston rod of which is pivotally connected by means of a likewise non-illustrated lever transmission, and by means of forked pieces 102, with the extended or elongated ends 103 of the two brackets 98.

The levers 76, 77 are forcibly engaged on that part of the lever arms thereof opposite the spherical surface 84 by a pressure spring 104, which is advantageously arranged in a bore 105 in the underside 87 of the workiece receiving plate 71 and exerts force against the lever in the release or loosening direction thereof. Consequently, each lever 76, 77 is so tilted during a movement of the wedges 78 counter to the direction of the arrow 85 that its engagement surface 88 or 89 is lifted a certain amount from the planar surface 90, 91 of the workpiece 68; as a result, the holding-down is discontinued. The workpieces can now be exchanged without any problem.

According to a further advantageous embodiment of the present invention, the honing tool 69, which is Cardanically received in a known manner in the machine spindle, is in the axial direction rigidly journalled in a dual manner on both sides of the workpiece receiving means.

The honing tool 69 for this purpose has a lower axial cylindrical extension 106 having associated therewith a guide bearing 107 arranged rigidly in the base plate 70. A second guide bearing 108 is rigidly arranged above the workpiece receiving means, with a segment of the honing tool located above the honing stones of the honing tool passing therethrough with slight radial play. The upper guide bearing 108 is radially adjustable by means of an adjustment ring 109 and adjustment screws 110 for attaining an accurate alignment of the two guide bearings 107, 108 with respect to each other.

An extremely rigid and compact journalling or support of the guide of the honing tool 69 is provided by the two guide bearings 107, 108 arranged directly adjoining both sides of the workpiece receiving means. This guidance of the honing tool 69 contributes to an advantageous, very high precision of the workpieces 68, which are to be machined.

The upper guide bearing 108 is inventively so embodied that it has a segment 111 which is larger in diameter, and faces the workpieces 68. A tubular conduit 112 for the supply of coolant and lubricant opens into this segment 111.

According to a further embodiment of the present invention, an especially good supplying of the individual workpieces 68 with coolant and lubricant is provided in that, starting from a central, vertically extending coolant and lubricant bore 113 in each workpiece receiving plate 71, there is provided a transverse bore 114 which opens into the through passage or bore for the honing tool 69. In this way, a direct supply of coolant and lubricant to the individual working zones is assured.

The forces on the angle levers 5, 76, 77 are suitably variable by the selection of appropriate lever transmissions of the arms *5a/5b, 76a/76b, 77a/77b*. Thus, a very heavy wedge can be used for attaining a high wedging force; the heavier weight can be balanced or equalized by a long arm *5b, 76b, 77b* in order to keep the engagement pressure small on the workpiece.

The present invention is, of course, in no way restricted to the specific disclosure of the specification and drawings, but also encompasses any modifications within the scope of the appended claims.

What I claim is:

1. An apparatus for holding at least one workpiece, such as a connecting rod, while honing a bore through the workpiece; wherein the workpiece has a first surface extending perpendicular to the axis of the bore and a second surface extending generally perpendicular to the first surface, the apparatus comprising:

at least one pair of first and second plates defining a space therebetween which space is wider than the thickness of the workpiece, the plates having a hole therethrough for receiving the honing tool, the workpiece resting against the first plate while being honed;

holding means for each pair of plates for holding the workpiece against the first plate while allowing the workpiece to slide on the first plate, the holding means comprising:

at least one rigid member mounted on the second plate for movement toward the first plate, the rigid member having at least one first surface for abutting only the first surface of the workpiece; while the workpiece is between the first and second plates and is being honed, the rigid member having a second surface thereon in juxtaposition with an opposed surface on one of the plates;

wedge means mounted on one of the plates, and means for inserting the wedge means between the second surface on the rigid member and the opposed surface on one of the plates once the first surface on the rigid member engages the first surface of the workpiece to lock the rigid member in place; whereby movement of the workpiece away from the first plate is precluded while sliding movement of the workpiece is allowed during honing, and means engaging one side of the workpiece along the second surface thereof to prevent rotation of the workpiece during honing.

2. The apparatus of claim 1 wherein the first and second plates extend horizontally; wherein the opposed surface extends vertically, and wherein means are provided for guiding the wedge means to drop vertically whereby the force exerted by the wedge means is dependent upon the weight of the wedge means.

3. The apparatus of claim 1 wherein the rigid member is pivoted with respect to the first and second plates.

4. The apparatus of claim 1 wherein there are a plurality of workpieces stacked vertically with the bores thereof aligned; and wherein there is a pair of first and second plates and a holding means for each workpiece.

5. The apparatus of claim 4 further including means for pivotally mounting the holding means with respect to the plates and wherein the opposed surfaces extend horizontally on the plates.

6. The apparatus of claim 5 wherein there are two holding members for each workpiece engaging the workpiece at opposite ends thereof.

7. The apparatus of claim 1 wherein the rigid member has a forked portion for stradling the bore of the workpiece, the forked portion having two first surfaces for abutting only the first surface of the workpiece which first surfaces abut the workpiece on opposite sides of the bore.

* * * * *